United States Patent [19]

Kawauchi

[11] Patent Number: 4,501,938

[45] Date of Patent: Feb. 26, 1985

[54] KEYBOARD SWITCH

[75] Inventor: Masahiko Kawauchi, Miyagi, Japan

[73] Assignee: Alps Electric Co., Ltd., Tokyo, Japan

[21] Appl. No.: 482,579

[22] Filed: Apr. 6, 1983

[30] Foreign Application Priority Data

Sep. 4, 1982 [JP] Japan ..... 57-50558[U]

[51] Int. Cl.[3] ..... H01H 9/00

[52] U.S. Cl. ..... 200/5 A; 200/159 B; 200/292

[58] Field of Search ..... 200/5 A, 159 B, 292

[56] References Cited

U.S. PATENT DOCUMENTS 4,228,329 10/1980 Inose et al. ..... 200/5 A 4,317,013 2/1982 Larson ..... 200/159 B X

*Primary Examiner*—A. D. Pellinen

*Assistant Examiner*—Morris Ginsburg

*Attorney, Agent, or Firm*—Guy W. Shoup; Gerard F. Dunne

[57] ABSTRACT

A keyboard switch includes a lower-electrode insulating sheet provided with an electrode pattern formed by arranging lower electrodes at given distances, each of the lower electrodes being composed of a pair of electrodes having interfitted teeth; and an upper-electrode insulating sheet provided with an electrode pattern formed by arranging a plurality of lines of rectangular upper electrodes so that each of the rectangular upper electrodes crosses the corresponding pair of teeth of the electrodes of the lower electrodes at right angles.

3 Claims, 8 Drawing Figures

KEYBOARD SWITCH

BACKGROUND OF THE INVENTION

1. Field of the Invention

The present invention relates to keyboard switches and more particularly to electrode patterns for such switches.

2. Description of the Prior Art

FIG. 1A shows a pattern for the lower electrode of a typical keyboard switch. An insulating sheet 1 made of an insulation material such as polyimide or the like has a plurality of lower electrodes 2 formed on the surface thereof at given distances by means of printing or the like. Each lower electrode 2 is formed by a pair of interfitted electrodes 2*a* and 2*b* shaped to resemble the teeth of a comb, which are arranged at a given distance.

As shown in FIG. 1A, the electrodes 2*a* of three lower electrodes 2 in the first line in the upper part of the insulating sheet 1 are interconnected and led to a terminal $4_1$ through a lead conductor $3_1$. In a similar manner, the electrodes 2*a* in the second and third lines are interconnected and led to terminals $4_2$ and $4_3$ through lead conductors $3_2$ and $3_3$, respectively.

On the other hand, the three electrodes 2*b* in the first column in the left part of the insulating sheet 1 are interconnected and led to a terminal $4_4$ through a lead conductor $3_4$. In a similar manner, the three electrodes 2*b* in the second and third columns are interconnected and led to terminals $4_5$ and $4_6$ through lead conductors $3_5$ and $3_6$, respectively.

FIG. 1B shows an upper-electrode pattern of the conventional keyboard switch. In the Figure, an insulating sheet 5 made of an insulation material such as polyimide or the like has rectangular upper electrodes 6 formed on the surface thereof in positions to face the lower electrodes 2 formed on the lower-electrode insulating sheet 1. The upper electrodes 6 cover the same general surface area as the lower electrodes 2.

The above-mentioned insulating sheets 1 and 5 are stacked, one upon the other with the lower electrodes 2 and the upper electrodes 6 made to face each other through spacers 7, as shown in FIG. 2A which is a sectional view of a part of a keyboard switch.

In addition, an insulation board 8 supports the lower-electrode insulating sheet 1.

In operation, by downwardly pressing the portion of the upper-electrode insulating sheet 5 on the side opposite to the side of the upper electrodes 6, the portion therebelow is deflected between the spacers 7 as shown in FIG. 2B. Contact of an upper electrode 6 with the teeth of the electrode 2 permits the electrodes 2*a* and 2*b* to conduct, thereby allowing a desired output to be led from the terminal 4.

The upper electrodes 6 for the conventional keyboard switch described above are disposed on the upper-electrode insulating sheet 5 at positions corresponding to the lower electrodes 2, and a decorative sheet or pattern is printed at P on the upper surface as the sheet 5 to provide an operation surface of the keyboard switch. Since the upper electrodes 6 must correspond to the patterns formed on the decorative sheet, different upper-electrode patterns are needed so as to correspond to decorative sheets of a variety of products. Consequently, it is necessary to increase the number of electrode patterns corresponding to a variety of products, so that design control becomes complicated.

SUMMARY OF THE INVENTION

An object of the present invention is to provide an upper-electrode pattern which can be used in common for a variety of products, thereby overcoming the above-mentioned disadvantage of the prior art.

Other objects and advantages of the invention will be apparent from the following description taken in connection with the accompanying drawings.

BRIEF DESCRIPTION OF THE DRAWINGS

FIGS. 1A and 1B show electrode patterns of a typical conventional keyboard switch, FIG. 1A showing a lower-electrode pattern on a lower-electrode insulating sheet, while FIG. 1B shows an upper-electrode pattern on an upper-electrode insulating sheet;

FIGS. 3A and 3B show electrode patterns of a keyboard switch in accordance with one preferred embodiment of the present invention, FIG. 3A being an enlarged view of an essential part of a lower-electrode pattern, while FIG. 3B is an enlarged view of an essential part of an upper-electrode pattern.

DESCRIPTION OF THE PREFERRED EMBODIMENT

Figure 1A:
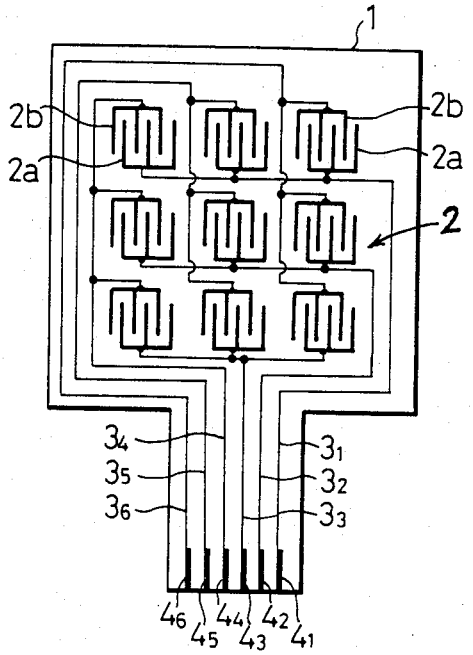
PRIOR ART Fig.1(A)
Figure 1B:
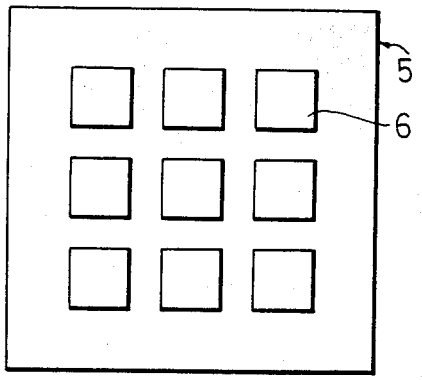
Fig.1(B) PRIOR ART
Figure 2A:
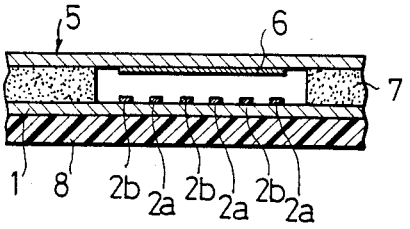
PRIOR ART Fig.2(A)
FIGS. 2A and 2B illustrate the operation of the conventional keyboard switch.
Figure 2B:
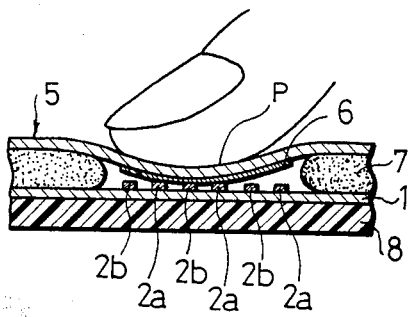
PRIOR ART Fig.2(B)

The subject matter of the present invention will be described hereinunder. Since the lower-electrode insulating sheet 1, the lower electrodes 2, the respective lead conductors for the lower electrodes 2, the insulation board 8, the spacers 7 and the like are the same as those in the example of the prior art, the same components are provided with the same reference numerals, respectively, and the detailed description thereof is omitted.

Figure 3A:
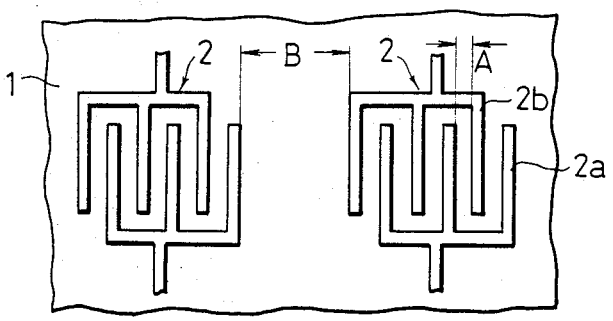
Figure 3B:
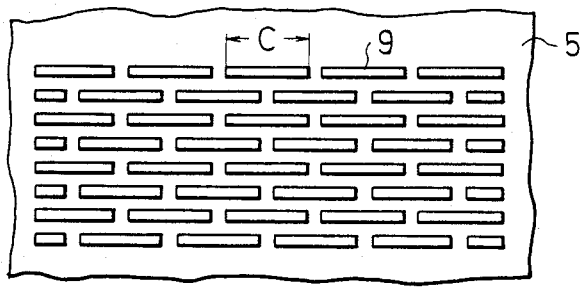

FIGS. 3A and 3B show one preferred embodiment of the present invention. FIG. 3A is an enlarged view of an essential part of the lower-electrode pattern, while FIG. 3B is an enlarged view of an essential part of an upper-electrode pattern.

The upper-electrode pattern is formed by a plurality of lines of rectangular upper electrodes 9 arranged over substantially all the surface of the insulating sheet 5. The lines of the upper rectangular upper electrodes 9 are offset from one another consecutively from the top to the bottom.

Each of the lower electrodes 2 has a pair of interfetting electrodes 2*a* and 2*b* having a comb-like configuration.

In this case, if the distance between adjacent teeth of the interfitted electrodes 2*a* and 2*b* is A, the distance between the adjacent lower electrodes 2 is B, and moreover the length of each of the rectangular upper electrodes 9 is C, the relationship among A, B and C should be $B>C>A$.

When a keyboard switch includes the upper and lower electrodes 9 and 2 described above, the insulating sheets 5 and 1 can be stacked one upon the other through the spacers 7 so that each of the rectangular upper electrodes 9 formed on the insulating sheet 5 crosses at right angles the comb teeth of the corresponding one of the pairs of electrodes 2*a* and 2*b* formed on the insulating sheet 1.

Figure 4A:
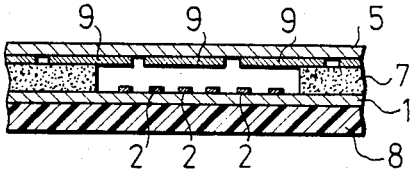
FIGS. 4A and 4B illustrate the operation of the keyboard switch of the present invention.

The operation of the keyboard switch employing the electrodes 2 and 9 in accordance with the present invention will be described hereinunder with reference to FIGS. 4A and 4B.

Figure 4B:
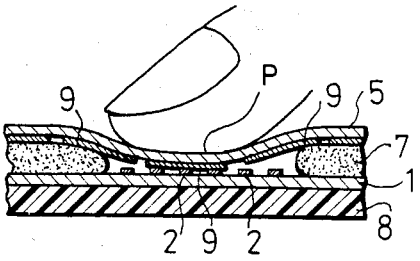

When a part of the decorative sheet disposed at P on the upper-electrode insulating sheet 5 facing the lower electrodes 2 of the lower-electrode insulating sheet 1 is pressed, the upper-electrode insulating sheet 5 is deflected between the spacers 7 as shown in FIG. 4B. Since the length C of each of the plurality of rectangular upper electrodes 9 deflected downwardly is larger than the distance A between a pair of electrodes 2*a* and 2*b*, the electrodes 2*a* and 2*b* below the depressed portion are connected electrically together, thereby closing the switch.

Moreover, since the length C of each of the upper electrodes 9 is smaller than the distance B between the adjacent lower electrodes 2, there is no possibility that any one of the upper electrodes 9 may cause the adjacent lower electrodes 2 to conduct to each other.

Formation of the electrode patterns with the arrangement as described above permits each of the plurality of rectangular upper electrodes 9 to be invariably brought into contact with the comb teeth of the corresponding one of the pairs of electrodes 2*a* and 2*b* of the lower electrodes 2 even if the pressing position on the decorative sheet disposed on the insulating sheet 5 is changed owing to a variation of products. Therefore, it is unnecessary to change the upper-electrode pattern for each type of product. Accordingly, there is no need for increasing the number of electrode patterns for a variety of products, so that design or the like is simplified and the keyboard switch of the present invention is more economical than the conventional ones.

Although only one embodiment of the invention has been disclosed and described, it is apparent that other embodiments and modification of the invention are possible.

What is claimed is:

1. A keyboard switch including an insulating sheet provided with a lower-electrode pattern formed by arranging lower electrodes at given distances, each of said lower electrodes being composed of a pair of electrode portions having interfitted teeth spaced from one another; and a second insulating sheet provided with an upper-electrode pattern formed by a plurality of lines of upper electrodes each formed by bar-shaped elements spaced from one another with the bar-shaped elements of each line being offset from the bar-shaped elements of the adjacent lines so that said upper electrodes can cross adjacent teeth of said pair of electrode portions of said lower electrodes.

2. A keyboard switch as defined in claim 1, wherein the distance A between said pair of electrode portions, the distance B between the adjacent ones of said lower electrodes, and the length C of each of said upper electrodes are related to each other under a condition of $B>C>A$.

3. In a keyboard switch having a lower electrode formed by a plurality of electrode elements arranged in pairs so that each pair may comprise a respective switch when connected electrically together, an upper electrode lying over said lower electrode and having electrode patterns adapted to electrically interconnect respective pairs of electrode elements when pressed theretowards, and a pattern formed over said upper electrode for indicating portions thereof to be depressed for connecting the respective pairs of electrode elements electrically together, the improvement wherein said electrode patterns of said upper electrode are arranged in a plurality of lines and each consists of a bar-shaped element, the bar-shaped elements of each line thereof being offset from the bar-shaped elements of adjacent lines whereby a common design for the upper electrode can be used for a wide variety of patterns that could be formed over said upper electrode.

* * * * *